US006633198B2

(12) United States Patent
Spalding, Jr.

(10) Patent No.: US 6,633,198 B2
(45) Date of Patent: Oct. 14, 2003

(54) LOW HEADROOM CURRENT MIRROR

(75) Inventor: George R. Spalding, Jr., Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/939,819

(22) Filed: Aug. 27, 2001

(65) Prior Publication Data

US 2003/0038671 A1 Feb. 27, 2003

(51) Int. Cl.[7] ..... G05F 1/10
(52) U.S. Cl. ..... 327/538; 323/315; 323/316
(58) Field of Search ..... 327/538, 540, 327/541, 543; 323/315, 316

(56) References Cited

U.S. PATENT DOCUMENTS 5,612,614 A * 3/1997 Barrett, Jr. et al. ..... 323/316

* cited by examiner

*Primary Examiner*—Kenneth B. Wells
(74) *Attorney, Agent, or Firm*—Wolf, Greenfield & Sacks, PC

(57) ABSTRACT

A circuit includes a current source providing an input current; first and second transistors having common control terminals and forming a current mirror generating a mirror current at the output of the second transistor. A control element having a first and second input and a first and second output is also provided; the first input being connected to the current source, the second input being connected to the output of the second transistor, the first output being connected to the common control terminals, and the second output being connected to the input of the first transistor of the current mirror. The control element is adapted to control the input to the first device and the voltage applied to the common control terminals in response to the inputs to the control device thereby maintaining the defined relationship between the input and output currents of the mirror. A method for implementing a current mirror in low headroom environments is also described.

17 Claims, 4 Drawing Sheets

LOW HEADROOM CURRENT MIRROR

FIELD OF THE INVENTION

The invention relates generally to electronic circuits and in particular to an electronic circuit configured as a current mirror and more particularly to a current mirror adapted for implementation where there is low headroom.

BACKGROUND TO THE INVENTION

A current mirror is a current controlled circuit which when fed with an input current outputs and an identical current. As such, they have many applications and are widely used in Integrated Circuit (IC) design.

FIG. 1 shows one such known current mirror 100 comprising two matching bipolar npn transistors Q1, Q2, whose bases are linked. When an input current (Iin) is fed into the diode connected first transistor Q1, it forces Q1 to generate a forward base emitter voltage which is a function of the applied current and which is applied directly to the base-emitter junction of the second transistor Q2, causing it to sink an almost identical collector current (Isink). It will be understood that Q2 thus acts as a current sink that is controlled by Iin, but has the advantage of acting as such even at low collector voltages. A problem with this current mirror is the high variability in the output current with changes in the output voltage (namely the collector emitter voltage).

FIG. 2 shows an alternative current mirror utilizing two Field Effect Transistor (FET) devices, Mn1, MN2. Again, this circuit tries to satisfy the following equation:

$$Iout=kIin \qquad \text{(equation 1)}$$

where Iin is the current of the current source and Iout is the output current flowing from the voltage source. This is difficult to achieve using circuitry such as that of FIG. 2 in that variations in drain-source voltages can cause a mismatch between input and output transistors resulting in high variability in the output current with changes in the output voltage. A modification to this circuit is shown in FIG. 3, where a second current mirror comprising a second set of transistors MN3, MN 4 is included. These additional devices ensure that the voltages measured across the drain and source (Vsd) of both MN1 and MN2 are equivalent. In doing so, the current mirror's output current becomes less sensitive to changes in its output voltage. Unfortunately this implementation, although solving the problems associated with the circuits of FIGS. 1 and 2 and solving equation 1, requires a lot of headroom at the output of the circuitry so as to cater for the third transistor MN3 at the output; resulting in a stacking of two transistors thereby requiring two Vsd voltages.

A second problem with known current mirrors is that most of the known implementations require the devices with which they are made to remain in a region of operation where they have reasonably large output impedance. A simple MOS mirror, for example, will have very inaccurate current gain and poor output impedance if the output device leaves saturation. Unfortunately, in most mirrors, gain accuracy, statistical matching and output impedance all degrade as the headroom over them is decreased. While this is true generally, it is especially true if the devices leave the "normal" area of operation.

There is therefore a requirement for a device that overcomes the problems associated with known circuits by providing a current mirror which may be used in situations where low headroom is available.

SUMMARY OF THE INVENTION

In accordance with one embodiment of the present invention a current mirror is provided with an input current and an output current having a defined relationship with the input current and which is adapted to be operable in situations where low headroom is available. The mirror comprises a first and second device, each device having a primary control, a primary output and a secondary output. The primary control of each device is connected at the same potential and the secondary output of the two devices is connected at the same potential. The primary output of the second device forms the output of the mirror. A control element having a first and second input and a first and second output is also provided, the first input being connected to the input current of the mirror, the second input being connected to the primary output of the second device, the first output controlling the potential at the primary control of the first and second devices, and the second output being connected to the primary output of the first device. The outputs of the control element are adapted to force the primary output current of the first device to match a defined ratio of the input current and the voltage on the primary output of the first device to match the voltage at the primary output of the second device, thereby maintaining the defined relationship between the input and output of the mirror.

In a first embodiment the first and second devices are Field Effect Transistors (FETs); the primary control of each FET being the Gate, the primary output—the Drain, and the secondary output—the Source.

In a second embodiment of the present invention the first and second devices are bipolar devices; the primary control of each bipolar transistor being the base, the primary output—the collector and the secondary output the emitter.

Desirably, the second control block input is a high impedance input thereby minimizing the current difference between the output current of the second device and the output of the current mirror.

The control element typically comprises an amplifier and a FET transistor, the amplifier having a first input connected to the drain of the second transistor and a second input connected to the drain of the first transistor, the amplifier having an output connected to the gate of a third transistor, the source of the third transistor being connected to the drain of the first transistor, the drain of the third transistor being connected to the input current and additionally being connected to the common gate terminals of the first and second transistors, the amplifier output changing the gate potential on detection of changes to the input of the amplifier so as to maintain a defined ratio between the drain current of the first transistor and the input current and the voltage on the drain of the first transistor with that of the voltage on the drain of the second transistor thereby maintaining a defined relationship between the input and output of the mirror.

The current mirror of the present invention is advantageous over prior art implementations in that the control circuitry changes the primary control of the first and second transistors to compensate for changes in the output voltage. This results in a higher effective output impedance for the mirror without adding additional devices to the output leg of the mirror.

As a single transistor is utilized at the output it is possible to implement the mirror of the present invention in devices having low output headroom, it is also possible to operate the output transistor in a region other than that which would be normal for most mirrors without a significant degradation in performance as the control element compensates for variations in region of operation in the output device. When implemented using FET devices it will be appreciated that the device may be operated over broader ranges as the control element effects a broadening of the useful region of operation of the transistor beyond what would normally be considered a normal, or saturated, region of operation.

These and other features of the present invention will now be described with reference to the following Figures which are illustrative of the present invention but not intended to limit the present invention to that described.

DETAILED DESCRIPTION OF THE DRAWINGS

Figure 1:
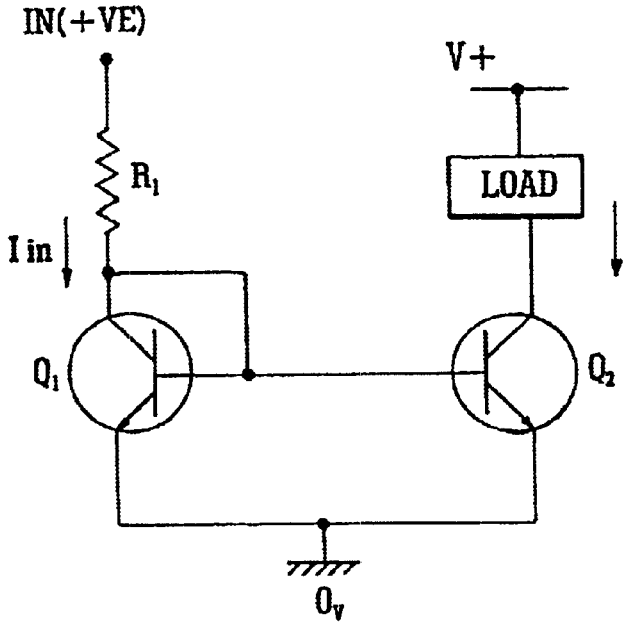
(PRIOR ART) FIG. 1
FIG. 1 shows a known current mirror using bipolar devices.
Figure 2:
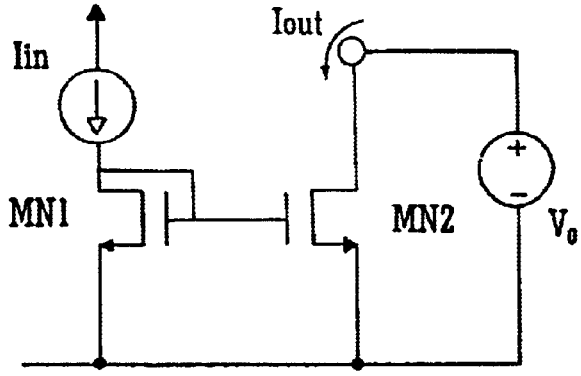
FIG. 2 (PRIOR ART)
FIG. 2 shows an alternative known current mirror using FET devices.
Figure 3:
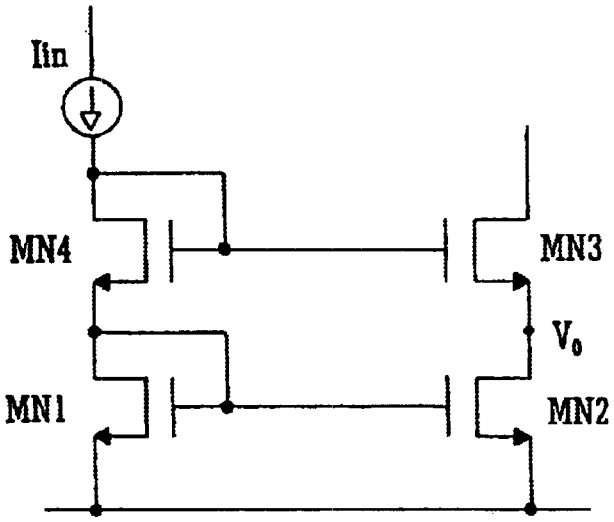
FIG. 3 (PRIOR ART)
FIG. 3 shows a modification to the circuit of FIG. 2 utilizing additional FET devices so as to effect a more stable output.

FIGS. 1 to 3 have been hereinbefore described with reference to the prior art.

Figure 4:
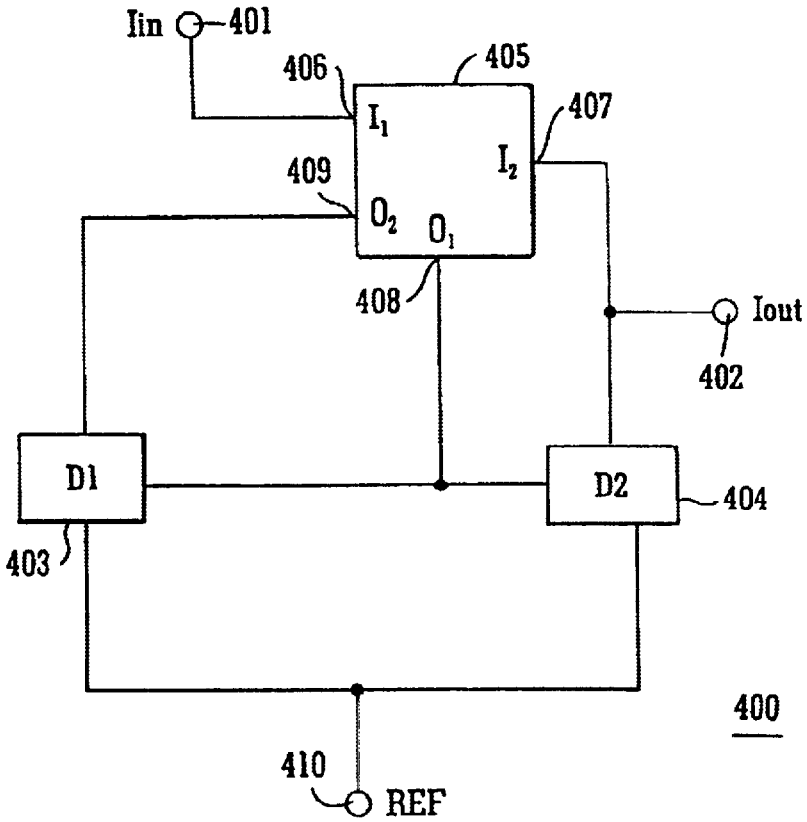
FIG. 4 shows a block diagram of a circuit according to the present invention.

FIG. 4 shows an example of a current mirror 400 according to the present invention adapted to provide a solution to both the implementation of current mirrors in situations of low headroom and where it is required to operate a device outside its normal region of operation.

The mirror 400 of this exemplary embodiment has an input current node 401 adapted to receive an applied current $I_{in}$, and an output current node 402 adapted to provide a mirrored output current $I_{out}$, the input and output currents having a defined relationship therebetween. A first 403 and second 404 three-terminal devices (D1, D2) are provided, the two three-terminal devices forming a matching pair. Desirably the three-terminal devices are transistors, preferably of a MOS FET type, although it will be appreciated that any transconductance devices such as, but not limited to bipolar transistors, resistor degeneration configurations or other alternatives may be substituted depending on the application of the mirror. Two of the three terminals of each three-terminal device are common control terminals, with one of the common terminals being coupled to a ground or reference signal 410.

A control element 405 having a first 406 and second 407 input and a first 408 and second 409 output is also provided. The first input 406 is connected to the input current node 401 of the mirror and the second input to the non-common terminal of the second device 404. The first output 408 is coupled to the non reference common terminals of the first and second devices and the second output 409 is coupled to the non common terminal of the first device.

Figure 5:
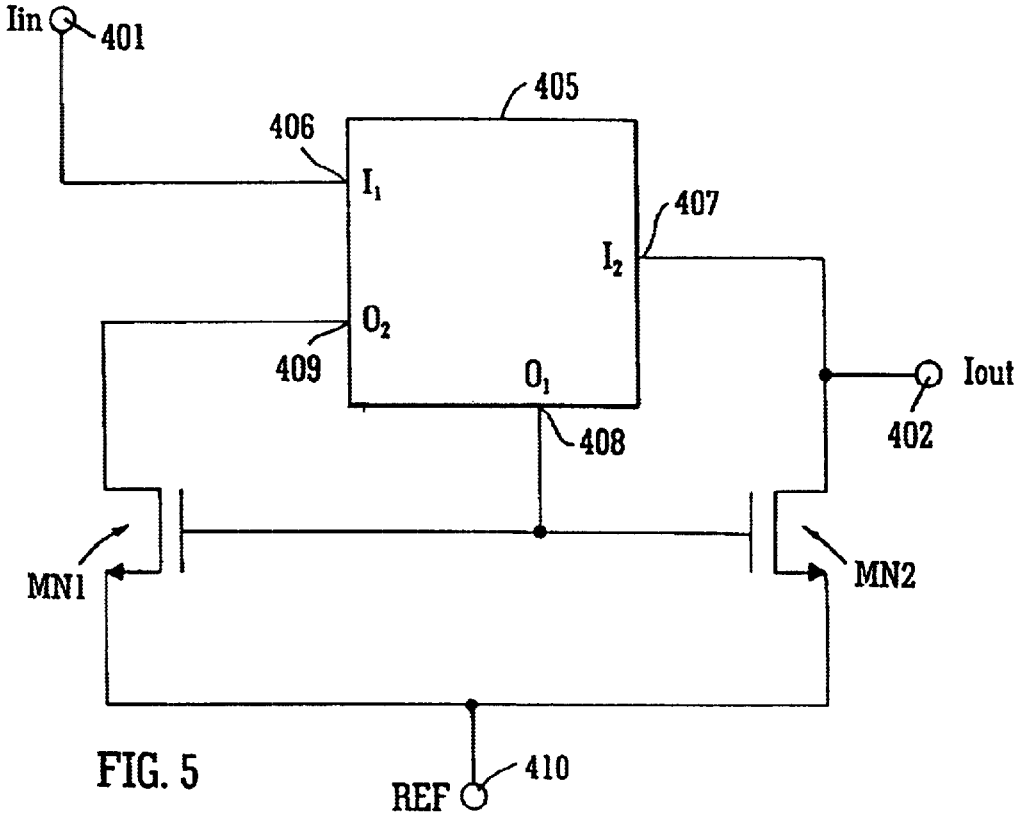
FIG. 5 shows an exemplary embodiment of the two devices shown in FIG. 4.

FIG. 5 shows in detail a preferred embodiment of the first and second devices of FIG. 4. Each of the first and second devices are FET devices (MN1, MN2) having what is conventionally termed a gate, a drain and a source. The first and second transistors have a common gate voltage and a common source voltage. As will be appreciated by those skilled in the art, this common source voltage need not be connected to ground, but to any potential that supplies a current path. The drain of the second transistor is connected to the output current node 402 of the mirror. The first input 406 of the control element is connected to the input current node of the mirror and the second input 407 to the drain of the second transistor MN2. The first output 408 is adapted to control the potential at the gates of the first and second transistors, and the second output 409 is connected to the drain of the first transistor The outputs of the control element are adapted to force the drain current of the first transistor to match a defined ratio of the input current and the voltage on the drain of the first transistor to match the voltage at the drain of the second transistor. By effecting this matching, it will be appreciated by those skilled in the art that the current mirror of the present invention maintains the defined relationship between current applied to the input node and that detected at the output node of the mirror.

Figure 6:
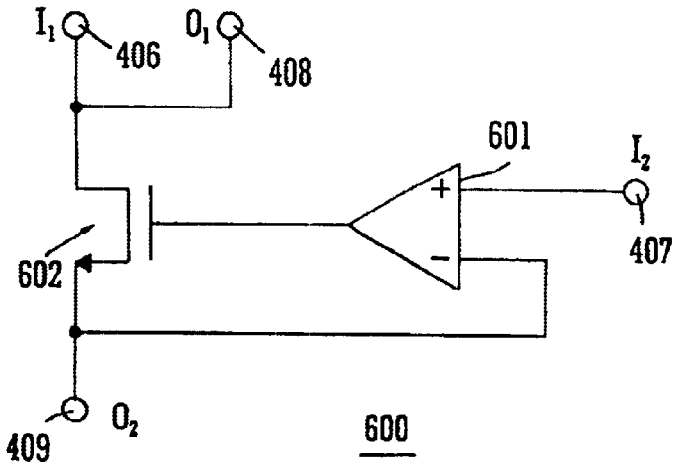
FIG. 6 shows an exemplary embodiment of the control element shown in FIG. 4.

FIG. 6 shows a practical implementation 600 of the control element of FIGS. 4 and 5 detailed in block format, and the same reference numerals will be used for equivalent components. The control element comprises an amplifier 601 and a FET transistor 602 combination. It will be appreciated that this transistor when used in combination with the transistors identified in FIG. 5 forms a third transistor of the circuit.

The amplifier has a first input 502 serving as the second input 407 to the control element and a second input coupled to the source of the third transistor 602. This node serves as the second output 409 of the control element. The output of the amplifier 601 is coupled to the gate of the transistor 602, whose drain is coupled to both the first input 406 and first output 408 of the control element. It will be appreciated that in this embodiment that the first output 408 is coupled directly to the first input 406. This coupling of the drain terminal of the third transistor to the input current source and to the common gate terminals of the first and second transistors thereby forms the first input and the first output terminal of the control circuitry.

Taking the specific example of the control element described above together with the circuit of FIG. 4, it will be appreciated that the control element serves to control the potential applied to the first device. The amplifier output, which results from a comparison of the potentials detected at the drains of the first and second transistors, controls the gate potential of the third transistor thereby modulating the potential applied to the first transistor so as to compensate for any fluctuations detected.

Figure 7:
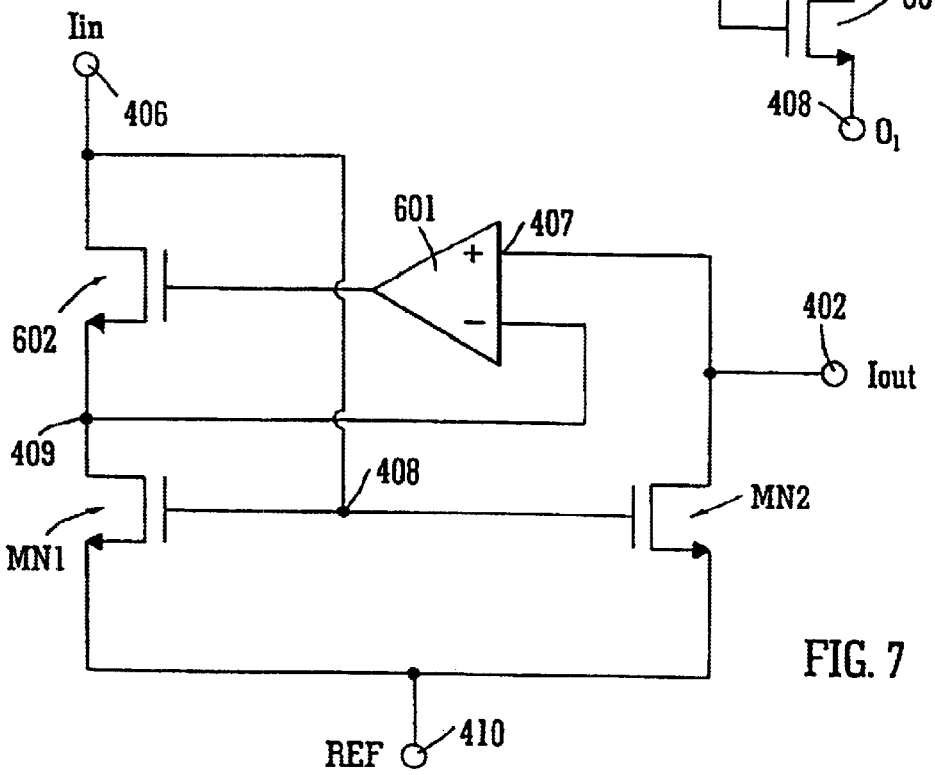
FIG. 7 shows a combination of the circuits previously shown in FIGS. 5 and 6.

FIG. 7 shows a combination of the circuits illustrated previously in FIGS. 5 and 6, so as to show the combination of the control element and two transistors in an exemplary circuit. The same reference numerals are used for the same components. It will be appreciated from this configuration that the control element is adapted to control the drain of the first transistor such that it is at the same potential as the drain of the second transistor, and to control the potential of the common gate terminals such that the drain current of the first transistor has a defined relationship to the input current.

Figure 8:
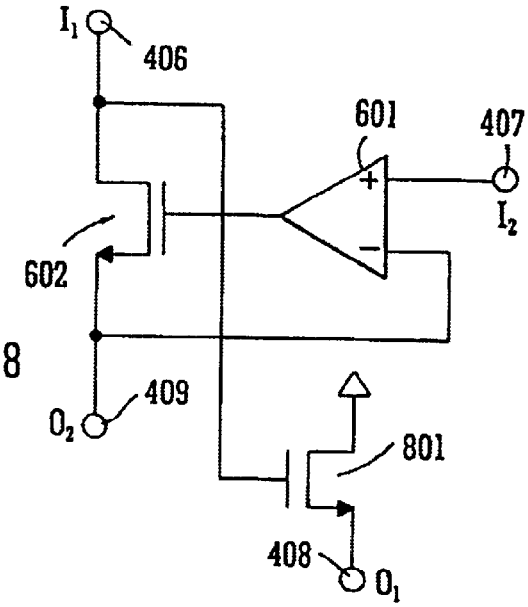
FIG. 8 shows an alternative embodiment of the control element shown in FIG. 6.

Although it has been shown as linking the gate connection of the first transistor directly to the input current, it will be appreciated that many modifications such as a connection through intermediary circuitry such as amplifiers, followers etc., could be considered and may have advantages in alternative applications. FIG. 8 shows a modification to the control element of FIG. 6 wherein the first input and first output are not directly coupled but a shift element 801 is provided between these two nodes. The shift element is provided between the first input and first output terminals of the control circuit, and is provided so as to extend the linear range of operation of the current mirror.

It will be appreciated by those skilled in the art that the combination of the cascoding of the first transistor and the amplifier servos the drain-source voltage of first transistor to match that of the second transistor. As both gates are tied, both transistors will have currents and small signal models related to one another by transistor size and matching alone.

It will be also appreciated that the input current may be constant or time varying, again depending on the application in which the current mirror is being implemented.

The output transistor of the present invention is able to leave saturation and the current gain will remain constant, and the output impedance will remain relatively high. This is resultant from the adjustment to the primary control and the output of the first transistor by the control circuitry so as to compensate for changes in the output voltage.

The implementation at the output node is effectively a virtual cascode and no explicit cascode device is required.

It will be appreciated that the transconductances of the first and second transistors are matched so that it is possible to accurately predict high and low frequency current gains.

As the output headroom of the mirror is determined by the drain/source voltage of the second transistor it will be appreciated that it can be set at values much lower than that of a saturated device, and limited only by device and amplifier matching, and other similar concerns.

It will be appreciated that if the output voltage goes higher than the gate of the second transistor that the amplifier will rail and the third transistor will therefore become a switch, shorting the gate and drain of the first transistor, turning it into a simple current mirror such as that illustrated in FIG. 1, and effecting a graceful failing of the circuit. As the second transistor is now in saturation, it is less critical that its output impedance be increased by the gain of the amplifier/cascode. In BJT devices it will be appreciated that this would not happen but that the range of normal operation could be extended with additional circuitry between the input and the base of the first and second transistors. The circuit is additionally adapted to gracefully fail with increased frequency such as when the gain of the amplifier loop is gone the output impedance reduces to that of the second transistor but, as the trasnsconductances still match, the current gain remains accurate. This, it will be appreciated, has beneficial applications in application that require stable gain such as control loops.

Figure 9:
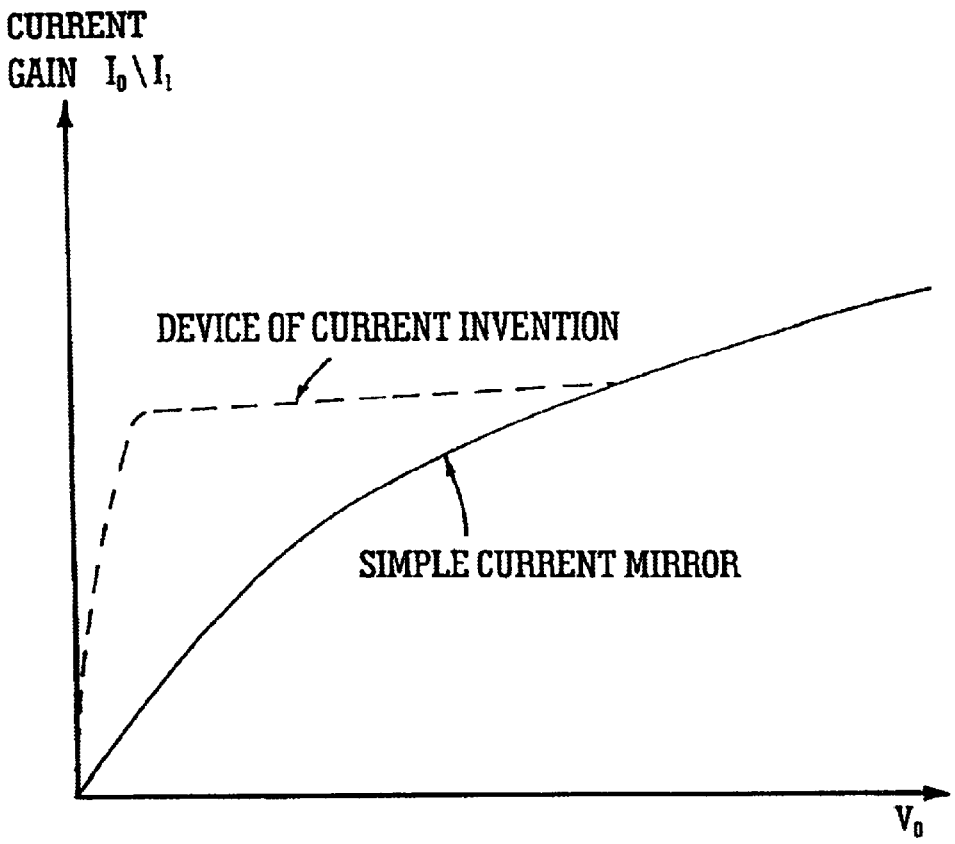
FIG. 9 shows a graph of operation of both a simple current mirror and a device according to the present invention.

FIG. 9 shows a graph of current gain of both a simple current mirror such as that shown in FIG. 1 and a device of the present invention verses output voltage. The operation of the simple current mirror is shown in solid line whereas that of the present invention is shown in dashed outline. It will be appreciated by those skilled in the art that the desired mode of operation of a current mirror requires an output current related solely to input current. In low output voltage operational regions (such as those encountered in situations of low output headroom) it will be appreciated that the simple current mirror device fails whereas the circuitry of the present invention extends this range considerably. In high headroom operations the response of the two circuits is equivalent and at very low headroom operational regions the device of the present invention fails in a manner equivalent to that of the simple current mirror. The inclusion of a level shifter or shift element such as that shown in FIG. 8 serves to extend the linear region of operation of the device of the present invention, delaying the ramping effect that is seen when the region of operation of the device of the present invention overlaps with that of the simple current mirror.

Figure 10:
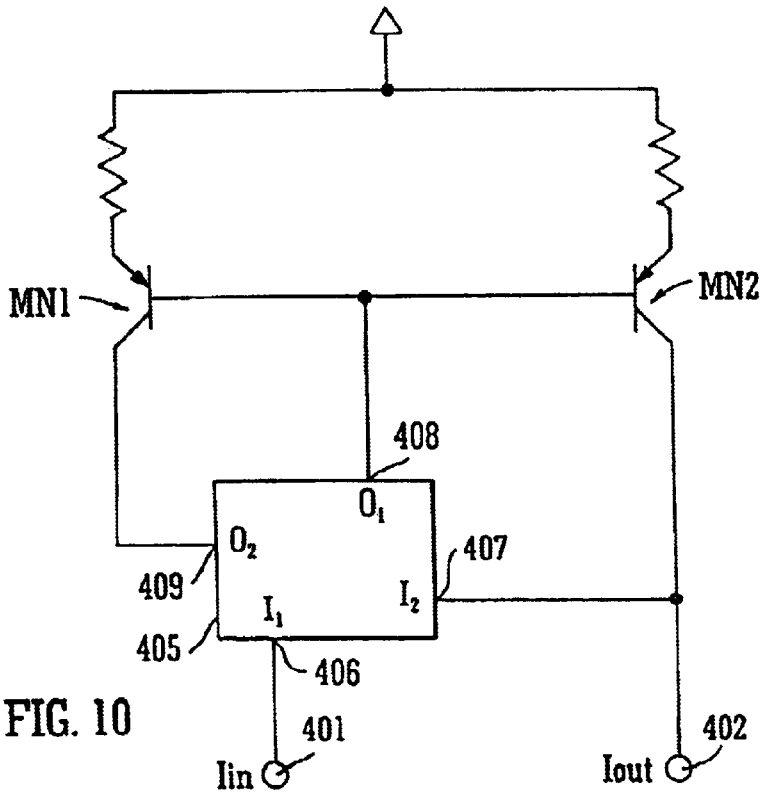
FIG. 10 shows an example of an alternative configuration of the device of the present invention with PNP bipolar transistors as opposed to N-type FETs.

FIG. 10 shows a modification to the circuitry hereinbefore described wherein the N-type FET mirror as previously described is replaced with a PNP mirror with resistor degeneration. The same reference numerals are used for similar components to that previously described devices. As described previously the control means effect a control on the operation of the first and second transistors (MN1, MN2) so as to maintain a defined relationship between the input and output currents, thereby maintaining the operation of the circuitry as a current mirror.

It will be appreciated by those skilled in the art that the exemplary embodiments of the present invention have been described with reference to FET devices but that it is not intended to limit the operation of the present invention to such specific devices. The skilled person will appreciate that these FET devices can be replace with other devices that operate in a similar manner such as but not limited to other transconductors such as bipolar transistors, degenerated transistors, tubes, or more complicated circuitry providing a current from a control voltage, and that the term transistor is intended to encompass all such devices. Obviously the changing of components may require some change in terminology such as where previously describing the primary control, the primary output and the secondary output as the gates, drain and sources respectively, a bipolar transistor has terminals termed, in accordance with standard convention, the base, collector and emitter respectively. It will be appreciated that the operation of the mirror of this second embodiment is similar to that outlined above. Again, it will be appreciated that the insertion of circuitry between the base and the collector may be used to increase the range.

It will be appreciated by those skilled in the art that the embodiments hereinbefore described are illustrative of the present invention and it is not intended to limit the present invention to the examples herein described. Numerous modifications to the design of the circuitry will be appreciated by those skilled in the art and it will be appreciated that the circuitry can be easily changed or modified to reflect change in bias of the transistor arrangements etc. Such standard modifications are well known in the art.

The words "comprises/comprising" and the words "having/including" when used herein with reference to the present invention are used to specify the presence of stated features, integers, steps or components but does not preclude the presence or addition of one or more other features, integers, steps, components or groups thereof.

There has been described herein a current mirror which may be implemented in situations that offer less headroom and therefore offers distinct advantages when compared with the prior art. It will be apparent to those skilled in the art that modifications may be made without departing from the spirit and scope of the invention. Accordingly, it is not intended that the invention be limited except as may be necessary in view of the appended claims.

What is claimed is:

1. A circuit comprising:

a current source providing an input current;

first and second devices having common control terminals and forming a current mirror, said current mirror generating a mirror current at the output of the second device, said mirror current having a defined relationship with the input current;

a control element having a first and second input and a first and second output, the first input being connected to the current source, the second input being connected to the output of the second device, the first output being connected to the common control terminals, and the second output being connected to the input of the first device of the current mirror, and wherein the control element is adapted to control the input to the first device and the voltage applied to the common control terminals in response to the inputs to the control device thereby maintaining the defined relationship between the input and output currents of the mirror.

2. The circuit of claim 1, wherein said first and second devices are transistors.

3. The circuit of claim 2, wherein said transistors are MOS transistors and the common control terminals of said first and second transistors are common gate terminals of the first and second transistor.

4. The circuit of claim 2 wherein said first and second transistors are bipolar transistors, and the common control terminals are common base terminals.

5. The circuit of claim 2 wherein the control element comprises an amplifier/transistor combination, the transistor of the amplifier/transistor combination being a three terminal transistor forming a third transistor of the circuit, and wherein:

a first terminal of the third transistor is coupled to the input current and to the common control terminals of the first and second transistors thereby forming the first input and first output of the control element, a second terminal of the third transistor is coupled to the first transistor thereby forming a second output of the control element, a third terminal of the transistor is coupled to the output of the amplifier, a first input of the amplifier is coupled to the output of the second transistor thereby forming the second input to the control element, and a second input of the amplifier is coupled to the second terminal of the transistor and the output of the first transistor, thereby forming a feedback loop to the amplifier, and wherein the output of the amplifier is related to a comparison of the two inputs to the amplifier thereby effecting a control on the second terminal of the third transistor and maintaining the relationship between the output current of the mirror with the input current.

6. The circuit as claimed in claim 5 wherein the first terminal of the third transistor and the input current are directly coupled to the common control terminals.

7. The circuit as claimed in claim 5 further comprising a shift element provided between the coupled first terminal of the third transistor and the input current and the common control terminals, such that the first terminal of the third transistor and the input current are not directly coupled to the common control terminals, the shift element adapted to extend the linear range of operation of the current mirror.

8. The circuit of claim 5, wherein said first, second and third transistors are Field Effect Transistors (FETs), and wherein the amplifier first input is connected to the drain of the second transistor and the second input connected to the drain of the first transistor, the amplifier output is connected to the gate of third transistor, the source of the third transistor being connected to the drain of the first transistor, the drain of the third transistor being connected to the input current, and wherein the coupling of the drain of the third transistor to the common gate terminals of the amplifier output changing the gate potential of the third transistor on detection of changes to the input of the amplifier.

9. A current mirror having an input current and an output current, the input and output currents having a defined relationship, the mirror comprising:

a first and second transistor, each transistor having a gate, drain and source, the gates of each transistor being connected at the same potential and the sources of the two transistors being connected at the same potential, the drain of the second transistor forming the output of the mirror;

a control element having a first and second input and a first and second output, the first input being connected to the input current of the mirror, the second input being connected to the drain of the second transistor, the first output controlling the potential at the gates of the first and second transistors, and the second output being connected to the drain of the first transistor; and wherein the outputs of the control element are adapted to force the drain current of the first transistor to match a defined ratio of the input current and the voltage on the drain of the first transistor to match the voltage at the drain of the second transistor, thereby maintaining the defined relationship between the input and output of the mirror.

10. The current mirror according to claim 9 wherein the second input is a high impedance input thereby minimizing the current difference between the output current of the second device and the output of the current mirror.

11. The current mirror according to claim 9 wherein the control element comprises an amplifier/transistor combination, the transistor forming a third transistor of the mirror and wherein the amplifier has a first input connected to the drain of the second transistor and a second input connected to the drain of the first transistor, the amplifier having an output connected to the gate of the third transistor, the source of the third transistor being connected to the drain of the first transistor, the drain of the third transistor being connected to the input current and the common gate terminals of the first and second transistors, the amplifier output changing the gate potential on detection of changes to the input of the amplifier.

12. A circuit comprising:

a current source providing an input current;

first and second FET transistors having a common gate voltage and a common source voltage and forming a current mirror, said current mirror generating a mirror current at the drain of the second transistor, said mirror current having a defined relationship with the input current;

a control element having a first and second input and a first and second output, the first input being connected to the current source, the second input being connected to the drain of the second transistor, the first output being connected to the common gate terminal of the first and second transistor, and the second output being connected to the drain of the first transistor, and wherein the control element is adapted to control the drain of the first transistor such that it is at the same potential as the drain of the second transistor, and to control the potential of the common gate terminals such that the drain current of the first transistor has a defined relationship to the input current.

13. The circuit of claim 12, where the first and second FET transistors are replaced with transconductors selected from the group consisting of bipolar transistors, degenerated transistors, tubes, and alternative circuitry providing a current from a control voltage.

14. The circuit of claim 12 wherein the control element comprises an amplifier/transistor combination, the transistor of the amplifier/transistor combination being a three terminal FET transistor forming a third transistor of the circuit, and wherein:

the drain terminal of the third transistor is coupled to the input current source and to the common gate terminals of the first and second transistors thereby forming the first input and the first output terminal of the control circuitry, and the source terminal of the third transistor is coupled to the drain of the first transistor thereby forming the second output terminal of the control circuitry, and the amplifier output drives the gate of the third transistor, and a first input of the amplifier is coupled to the drain of the second transistor forming the first input terminal of the control circuitry, and a second input of the amplifier is coupled to the source terminal of the third transistor and the drain of the first transistor, thereby forming a feedback loop to the amplifier.

15. The circuit of claim 14 wherein the third FET transistor is replaced with a transconductor selected from the group consisting of a bipolar transistor, a tube, and alternative circuitry providing a current from a control voltage.

16. The circuit of claim 14 wherein a shift element is provided between the first input and first output terminals of the control circuit, the shift element adapted to extend the linear range of operation of the current mirror.

17. A method for providing a low headroom operable current mirror having an input current and an output current, the input and output currents having a defined relationship, the mirror having a first and a second transistor, each transistor having a gate, drain and source, the gates of each transistor being connected at the same potential and the sources of the two transistors being connected at the same potential, the drain of the second transistor forming the output of the mirror, the method comprising a step of:

providing a control element having a first and second input and a first and second output, the first input being connected to the input current of the mirror, the second input being connected to the drain of the second transistor, the first output controlling the potential at the gates of the first and second transistors, and the second output being connected to the drain of the first transistor, and wherein the outputs of the control element are adapted to force the drain current of the first transistor to match a defined ratio of the input current and the voltage on the drain of the first transistor to match the voltage at the drain of the second transistor, thereby maintaining the defined relationship between the input and output of the mirror.

* * * * *